United States Patent [19]

King

[11] 4,231,756

[45] Nov. 4, 1980

[54] GASOLINE AND PETROLEUM FUEL SUPPLEMENT

[76] Inventor: Samuel B. King, 2985 McGavach Pike, Nashville, Tenn. 37214

[21] Appl. No.: 38,288

[22] Filed: May 11, 1979

[51] Int. Cl.[2] ..... C10L 1/18; C10L 1/16

[52] U.S. Cl. ..... 44/53; 44/56; 44/57; 44/67; 44/77

[58] Field of Search ..... 44/53, 56, 51, 57, 67, 44/77

[56] References Cited

U.S. PATENT DOCUMENTS

| | | | |
|---|---|---|---|
| 1,684,686 | 9/1928 | Records | 44/53 |
| 3,765,848 | 10/1973 | Brent | 44/51 |
| 4,020,798 | 5/1978 | Skala | 123/1 A |
| 4,081,252 | 3/1978 | Osborg | 44/53 |
| 4,088,454 | 5/1978 | Lee | 44/56 |
| 4,110,082 | 8/1978 | Van Michaels-Christopher | 44/50 |

*Primary Examiner*—Winston A. Douglas
*Assistant Examiner*—J. V. Howard
*Attorney, Agent, or Firm*—Nicholas J. Aquilino

[57] ABSTRACT

A gasoline and petroleum fuel supplement formed of a combination of ingredients including methyl alcohol, xylene, ethyl alcohol, and at least one alkali metal hydroxide. These ingredients may be added in various ratios to gasoline and/or to treated water for use as fuel supplement in an internal combustion engine.

4 Claims, No Drawings

GASOLINE AND PETROLEUM FUEL SUPPLEMENT

BACKGROUND OF THE INVENTION

The present invention relates to a new gasoline and petroleum fuel supplement for use in internal combustion engines which results in or causes more complete combustion of the fuel in the engine and a reduction in the overall amount of pollution emitted from the engine exhaust.

Some reason for present inefficiencies of gas as fuel in the present internal combustion engine include that the gasoline vapor is diluted with about 68 times its volume of air 4/5 of which is inert nitrogen taking no part in the reaction, but rather tending to hinder and retard the combustion. This mixture under ordinary pressure would not burn, much less explode. The compression of this mixture before explosion can be taken to be about 80 pounds per square inch owing to the risk of premature ignition. Explosion then takes place with such rapidity that its diluting action of the inert nitrogen prevents complete combustion. Results of the incomplete combustion thus caused are low efficiency, carbon deposits in the engine, unburned blow-by vapors of poisonous gases, hydrocarbons, monoxides and the like which now attend the present gasoline powered motor.

It is known that a temperature of about 1200° C. is needed to ignite the ordinary gasoline and air mixture at atmospheric pressure. At the moment of explosion, such portions of hydrocarbons as do not happen to be in contact with the proper quantity of oxygen required for their combustion, owing to the hindering action of the inert nitrogen, undergoes changes of various complexity. The result is that the products of combustion contain not only products of complete combustion but also the products of incomplete combustion. These are formed by the heat at the moment of explosion and these products combined with lubricants provide odors associated with gasoline motors and also deposit films of carbon on the inside of the cylinders.

Prior art patents relating to internal combustion engines and novel fuel compositions therefor are shown in the patents to Brent U.S. Pat. No. 3,765,848 relating to a motor fuel composition, Skala U.S. Pat. No. 4,020,798 for an internal combustion engine fuel by NAK, Osborg U.S. Pat. No. 4,081,252 for a method of improving combustion of fuels and fuel compositions, Lee U.S. Pat. No. 4,088,454 for a method for producing a liquid fuel composition, and Michaels-Christopher U.S. Pat. No. 4,110,082 for a reformed hydrocarbons and alcohols from fuel alloys and reforming agents.

The present fuel supplement is a newly created formulation of chemicals which may be combined with gasoline and/or water to provide more complete combustion when used with gasoline in the present day internal combustion engine. The present mixture and ratio between the ingredients and the amount of gasoline is determined by the construction of the motor, weight of the vehicle and conditions of operation.

The present supplement provides increased gasoline mileage of up to 50% or more. It produces gaseous vapor which cause the blow-by vapors in the engine to burn when they become united in the motor. Consequently, the normally harmful dangerous and wasted hydrocarbons and other gases as well as the inert nitrogen gases which are currently wasted, burn more cleanly during combustion.

This provides a reduced level of air pollution from internal combustion engines and reduces oil consumption by as much as 50% or more due to less contamination because of the more complete combustion.

The use of the supplement provides clean engine parts due to a cooler running cycle, less carbon deposits inside the engine as well as less gases entering the crank case to contaminate the oil. This produces an expected longer life of parts and engines. The supplement reduces combustion heat and allows engines to run cool and reduces gasoline octane rating required for internal combustion engines.

The fuel supplement is formed of a combination of essential ingredients in the following relative proportions: 250 to 1500 ml of methyl alcohol, 100 to 800 ml of xylene, 250 to 1500 ml of ethyl alcohol, 200 to 800 mg of potassium hydroxide, and 200 to 800 mg of sodium hydroxide. The sodium hydroxide and potassium hydroxide may be added to the other ingredients in solid form in the above stated proportions or may, in the alternative, be added in the form of an aqueous solution. When an aqueous solution of the hydroxides is used, the solutions may comprise, for example, from about 150 to 600 g/l of the respective hydroxides. Obviously, the size of the batch of fuel supplement produced is a matter of choice so long as the relative proportions of ingredients is maintained as stated above.

In addition, from about 10 to about 60 cc of cobalt chloride, sodium peroxide, sodium bromide and/or sodium oxide, may be added to the above supplement to reduce the pollution in the engine.

When the above ingredients forming the supplement are mixed together, the total mixture is then mixed either with gasoline or with water. When the supplement is mixed with water, the final product comprises one third to two thirds by volume supplement and the remainder water. When the supplement is mixed with gasoline, the product comprises from about 70 to 90% by volume of supplement and from about 10 to 30% by volume of gasoline.

Either of these mixtures may be injected or otherwise added to the carburation system in an internal combustion engine. Alternately, the supplement may be added directly to the gasoline in the fuel tank. It has been found that approximately one ounce of supplement per gallon of fuel achieves the desired results.

The advantages of the invention will be appreciated more fully in view of the following examples.

EXAMPLE 1

A fuel supplement was used in a 1977 Plymouth with a 318 V8 engine having a 4220 pounds registered weight. The supplement was formed by mixing 900 milliliters of methyl alcohol, 200 milliliters of xylene, 900 milliliters of ethyl alcohol, 500 mg potassium hydroxide dissolved in 15 ml of water, and 500 mg of sodium dissolved in 15 ml of water. The supplement was vaporized and the gaseous vapors were added through the carburator to the combustion chamber. The mileage increased from 15 miles per gallon, without using the supplement, to 27 miles per gallon, on the average, using the supplement.

EXAMPLE 2

Example 1 was repeated, except that 33 cc of sodium bromide, industrial grade, purchased from Fishers Scientific Laboratories, St. Louis, Missouri, was added to the supplement. A similar increase in mileage was evidenced, along with a decrease in the pollutants leaving through the exhaust.

EXAMPLE 3

Example 1 was repeated, except that 20 cc of sodium peroxide, industrial grade, purchased from Fishers Scientific Laboratories, St. Louis, Missouri, was added to the supplement. A similar increase in mileage was evidenced, along with a decrease in the pollutants leaving through the exhaust.

EXAMPLE 4

Example 1 was repeated, except that 50 cc of cobalt chloride, industrial grade, purchased from Fishers Scientific Laboratories, St. Louis, Missouri, was added to the supplement. A similar increase in mileage was evidenced, along with a decrease in the pollutants leaving through the exhaust.

EXAMPLE 5

Example 1 was repeated, except that 60 cc of sodium oxide, industrial grade, purchased from Fishers Scientific Laboratories, St. Louis, Missouri, was added to the supplement. A similar increase in mileage was evidenced, along with a decrease in the pollutants leaving through the exhaust.

It will be appreciated that the proportion of the combination of ingredients may be varied in keeping within the ranges specified above.

What is claimed is:

1. A fuel supplement comprising 250 to 1500 ml of methyl alcohol, 100 to 800 ml of xylene, 250 to 1500 ml of ethyl alcohol, 200 to 800 mg of potassium hydroxide and 200 to 800 mg of sodium hydroxide.

2. A fuel supplement in accordance with claim 1 further comprising 10 cc to 60 cc of salt selected from the group consisting of cobalt chloride, sodium peroxide, sodium bromide and sodium oxides.

3. A fuel supplement in accordance with claim 1 further comprising water wherein the water is present in from about $\frac{1}{3}$ to $\frac{2}{3}$ of the total mixture.

4. A fuel supplement in accordance with claim 1 further comprising gasoline, wherein the gasoline is present in from about 10 to 50% by volume of the total mixture.

* * * * *

UNITED STATES PATENT AND TRADEMARK OFFICE

CERTIFICATE OF CORRECTION

PATENT NO. : 4,231,756

DATED : November 4, 1980

INVENTOR(S) : Samuel B. King

It is certified that error appears in the above—identified patent and that said Letters Patent is hereby corrected as shown below:

Claim 1, line 1, after "comprising" delete "250 to 1500 ml of" and insert -- methyl alcohol, ethyl alcohol, xylene, postassium hydroxide and sodium hydroxide wherein the ingredients are employed in the following relative proportions: 250 to 150 ml of methyl alcohol, 250 to 1500 ml of ethyl alcohol, 100 to 800 ml of xylene, 200 to 800 mg of potassium hydroxide and 200 to 800 mg of sodium hydroxide. --

Claim 1, lines 2 through 4, delete in their entirety.

Signed and Sealed this

*Seventeenth* Day of *March 1981*

[SEAL]

*Attest:*

RENE D. TEGTMEYER

*Attesting Officer* *Acting Commissioner of Patents and Trademarks*